US007303430B2

(12) United States Patent
Butcher

(10) Patent No.: US 7,303,430 B2
(45) Date of Patent: Dec. 4, 2007

(54) ADAPTER FOR CAR AUDIO EQUIPMENT

(75) Inventor: Peter Butcher, Oxnard, CA (US)

(73) Assignee: Scosche Industries, Inc., Oxnard, CA (US)

( * ) Notice: Subject to any disclaimer, the term of this patent is extended or adjusted under 35 U.S.C. 154(b) by 0 days.

(21) Appl. No.: 11/313,013

(22) Filed: Dec. 20, 2005

(65) Prior Publication Data

US 2006/0183353 A1 Aug. 17, 2006

Related U.S. Application Data

(60) Provisional application No. 60/654,041, filed on Feb. 16, 2005.

(51) Int. Cl.
*H01R 11/00* (2006.01)

(52) U.S. Cl. ..... 439/502; 439/34; 174/72 A

(58) Field of Classification Search ..... 439/34, 439/502, 505; 174/72 A
See application file for complete search history.

(56) References Cited

U.S. PATENT DOCUMENTS 6,531,657 B1 * 3/2003 Jones et al. ..... 174/72 A
2007/0015537 A1 * 1/2007 DeBiasio et al. ..... 455/556.1

* cited by examiner

*Primary Examiner*—Khiem Nguyen
(74) *Attorney, Agent, or Firm*—Craig Gelfound McDermott Will & Emery, LLP

(57) ABSTRACT

An adapter for installing an aftermarket audio device in a vehicle. The adapter includes a first and second connectors electrically connected together, the first connector being suitable for connecting to a wiring harness in the vehicle and the second connector being unsuitable for connection to the wiring harness in the vehicle, the second connector being further suitable for connection in a different wiring harness in a different vehicle. The adapter also includes a plurality of wires electrically connected to the first and second connectors, the wires being adapted to connect to the aftermarket audio device.

12 Claims, 2 Drawing Sheets

ADAPTER FOR CAR AUDIO EQUIPMENT

CROSS REFERENCE TO RELATED APPLICATIONS

The present Application for Patent claims priority to Provisional Application No. 60/654,041 entitled, "ACCESSORY CONNECTOR", filed Feb. 16, 2005, the contents of which is expressly incorporated by reference herein.

BACKGROUND

1. Field

The present disclosure relates to automotive technology and, more particularly, to an adapter to connect an aftermarket stereo to an existing wiring harness in the vehicle.

2. Background

Automobile owners may upgrade their car stereos for a number of reasons. The original equipment manufacturer (OEM) stereos that are available with automobiles may not provide the owner with desired features. For example, an owner may wish to have CD player, but the OEM stereo may be a radio/cassette player. Instead of purchasing another vehicle, the owner may wish simply to upgrade the stereo from a cassette deck to a CD, or even a DVD player.

New stereos that replace these OEM stereos are commonly referred to as aftermarket stereos. Using these aftermarket stereos, owners may be able to obtain quickly the latest technology and/or new capabilities at a reasonable price.

An adapter is generally needed in order to connect the aftermarket stereo's wiring to existing vehicle circuitry. The customer must generally know the model and year for the vehicle to select the appropriate adapter. However, it is sometimes difficult for the customer to know which adapter is suitable for the particular vehicle at issue. This is particularly the case when the aftermarket stereo is being purchased by one who is not familiar with the model and year of the vehicle.

Accordingly, there is a need for a single adapter that connects aftermarket stereos to vehicles having a broad range of models and years.

SUMMARY

One aspect of an adapter for installing an aftermarket audio device in a vehicle is disclosed. The adapter includes first and second connectors electrically connected together, the first connector being suitable for connecting to a wiring harness in the vehicle and the second connector being unsuitable for connection to the wiring harness in the vehicle; and a plurality of wires electrically connected to the first and second connectors, the wires being adapted to connect to the aftermarket audio device.

Another aspect of an adapter for installing an aftermarket audio device in a vehicle is disclosed. The adapter includes first and second connectors electrically connected together, the second connector being adapted for a different wiring harness in a different vehicle, and a plurality of wires electrically connected to the first and second connectors, the wires being adapted to connect to the aftermarket audio device.

A further aspect of an adapter for installing an aftermarket audio device in a vehicle is disclosed. The adapter includes a first group of connectors suitable for connecting to a wiring harness in the vehicle, and a second group of connectors being unsuitable for connection to the wiring harness in the vehicle, the first group of connectors being electrically connected to the second group of connectors, and a plurality of wires electrically connected to the first and second groups of connectors, the wires being adapted to connect to the aftermarket audio device.

Another aspect of an adapter for installing an aftermarket audio device in a vehicle is disclosed. The adapter includes first and second connectors electrically connected together, the first connector being suitable for connecting to a wiring harness in the vehicle and the second connector being unsuitable for connection to the wiring harness in the vehicle, the second connector being further suitable for connection in a different wiring harness in a different vehicle, and a plurality of wires electrically connected to the first and second connectors, the wires being adapted to connect to the aftermarket audio device.

An aspect of a method for using an adapter to install an aftermarket audio device in a vehicle is disclosed. The adapter has first and second connectors electrically connected together, the first connector being suitable for connection to a wiring harness in the vehicle, and the second connector being unsuitable for connection to the wiring harness in the vehicle, the adapter also has a plurality of wires electrically connected to the first and second connectors. The method includes connecting the first connector to the wiring harness in the vehicle, and connecting the adapter wires to the aftermarket audio device.

An aspect of an audio system in a vehicle is disclosed. The audio system includes an aftermarket audio device, a wiring harness configured to connect to an OEM audio device, an adapter comprising first and second connectors electrically connected together, the first connector being connected to the wiring harness and the second connector being unconnected, and wherein the second connector is suitable for connection to a different wiring harness in a different vehicle, and a plurality of wires electrically connecting the first and second connectors to the aftermarket audio device.

It is understood that other embodiments of the present invention will become readily apparent to those skilled in the art from the following detailed description, wherein it is shown and described only various embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive

BRIEF DESCRIPTION OF DRAWINGS

Various aspects of an accessory connector are illustrated by way of example, and not by way of limitation, in the accompanying drawings, wherein.

DETAILED DESCRIPTION

The detailed description set forth below in connection with the appended drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details. In some instances, well known structures and components are shown in block diagram form in order to avoid obscuring the concepts of the invention.

Various wiring harnesses are provided that permit aftermarket stereos to be connected to existing vehicle circuitry for automobiles of different models by the same manufacturer. Incorporating color-coded wiring according to Electronics Industry Association (EIA) standards, installation of the accessory connector is easy facilitated in a familiar way.

Ordinarily, the customer must know the model and year of the vehicle in order to find the proper wiring harness with the appropriate connector. However, in accordance with an embodiment of the present invention, a single wiring harness may be configured to adapt to any model or year vehicle for a particular manufacturer, or at least a range of models and years. For example, if the wiring harness is for a Toyota vehicle, the customer chooses the Toyota wiring harness. The customer does not have to identify the model or year of the vehicle. In some cases, particularly when purchasing for another person as a gift, information concerning the model and year may not be readily available to the customer.

Figure 1:
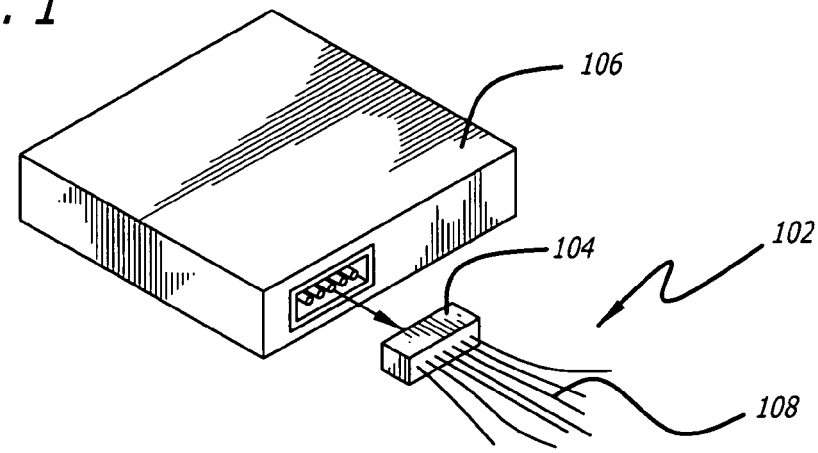
FIG. 1 is a perspective view of a wiring harness in a vehicle being removed from an OEM stereo.

FIG. 1 is a perspective view of a wiring harness in a vehicle being removed from an OEM stereo. The wiring harness 102 includes a connector 104 that plugs into the back of the OEM stereo 106. Extending from the rear of the connector 104 is a bundle of wires 108. The wires 108 may be used to provide power to the OEM stereo 104, as well as deliver an audio signal from the OEM stereo 104 to interior mounted speakers (not shown). The wires 108 in the wiring harness 102 may also be used to provide certain control signals to other audio components, such as power to the antenna (not shown). In FIG. 1, the wiring harness 102 is shown being removed from the OEM stereo 106 by unplugging the connector 104 of the wiring harness 102 from the back of the OEM stereo 106.

Figure 2:
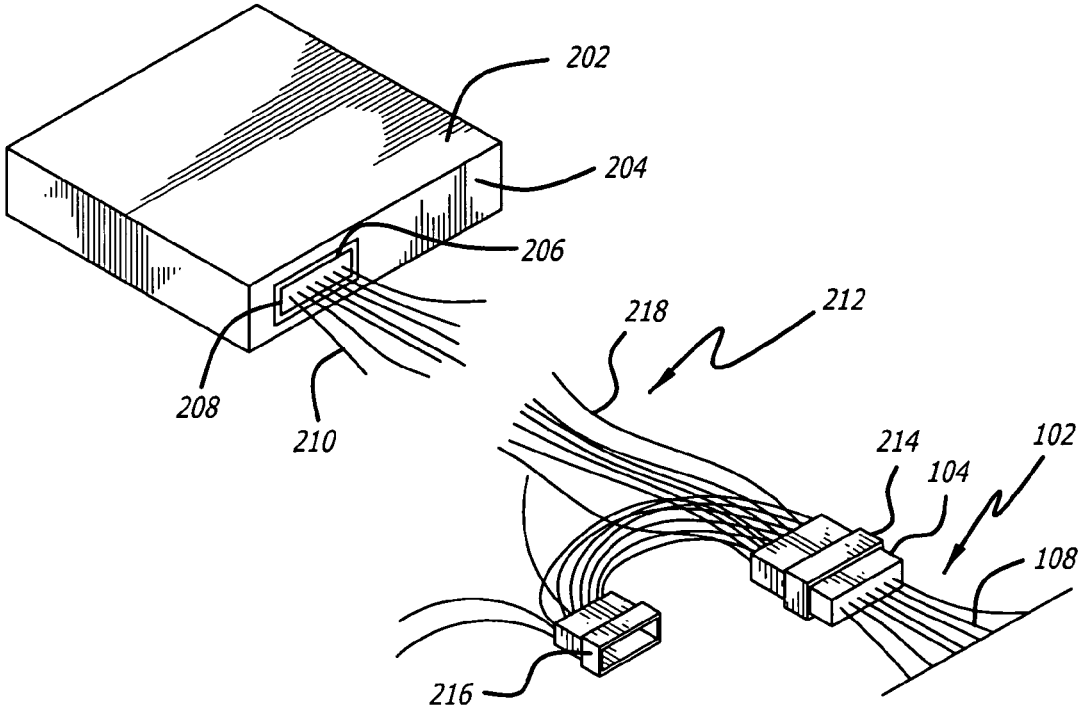
FIG. 2 is a perspective view illustrating the integration of an aftermarket stereo into an existing wiring harness of an automobile.

FIG. 2 is a perspective view illustrating the installation of an aftermarket stereo in a vehicle. The aftermarket stereo 202 has a back panel 204 with a receptacle 206 suitable to receive a plug 208. Extending from the rear of the plug 208 is a bundle of wires 210 with stripped ends for connecting to the battery, the speakers, and often times, other audio components. Although the wires 210 are shown extending from a plug, in alternative embodiments of the aftermarket stereo, the wires 210 may extend directly from the back panel 204.

In order to complete the installation of the aftermarket stereo 202, the wires 210 extending from the plug 208 need to be connected to the existing wiring harness 102 in the vehicle by means of an adapter 212. The adapter 212 is shown with two connectors 214 and 216. Extending from the first connector 214 is a bundle of wires 218 with stripped ends. These wires 218 may be connected to the wires 210 of the aftermarket stereo 202 by soldering, mechanical connection, or other means generally known in the art. The wires 210 and 218 may be color-coded according EIA standards for ease of installation.

To complete the installation process, the first connector 214 of the adapter 216 is connected with the connector 104 of the existing wiring harness 102 in the vehicle. Once this connection is made, power from the battery (not shown) can be provided to the aftermarket stereo 202. In addition, audio signals can be provided from the aftermarket stereo 202 to the speakers (not shown), along with control signals to other audio components.

The second connector 216 on the adapter 212 is configured to mate with a connector of a wiring harness in another vehicle with the same make, but having a different model and/or years. The wires extending from the back of the first connector 214 are piggy-backed to the appropriate pin connections on the second connector 216. Additional connectors may be added to the adapter 212 to increase the range of models and years that the adapter 212 can handle. When installing the adapter 212, the user simply selects the connector 214 or 216 that properly mates with the connector 104 for the existing wiring harness 102, and then makes the connection between the two.

Figure 3:
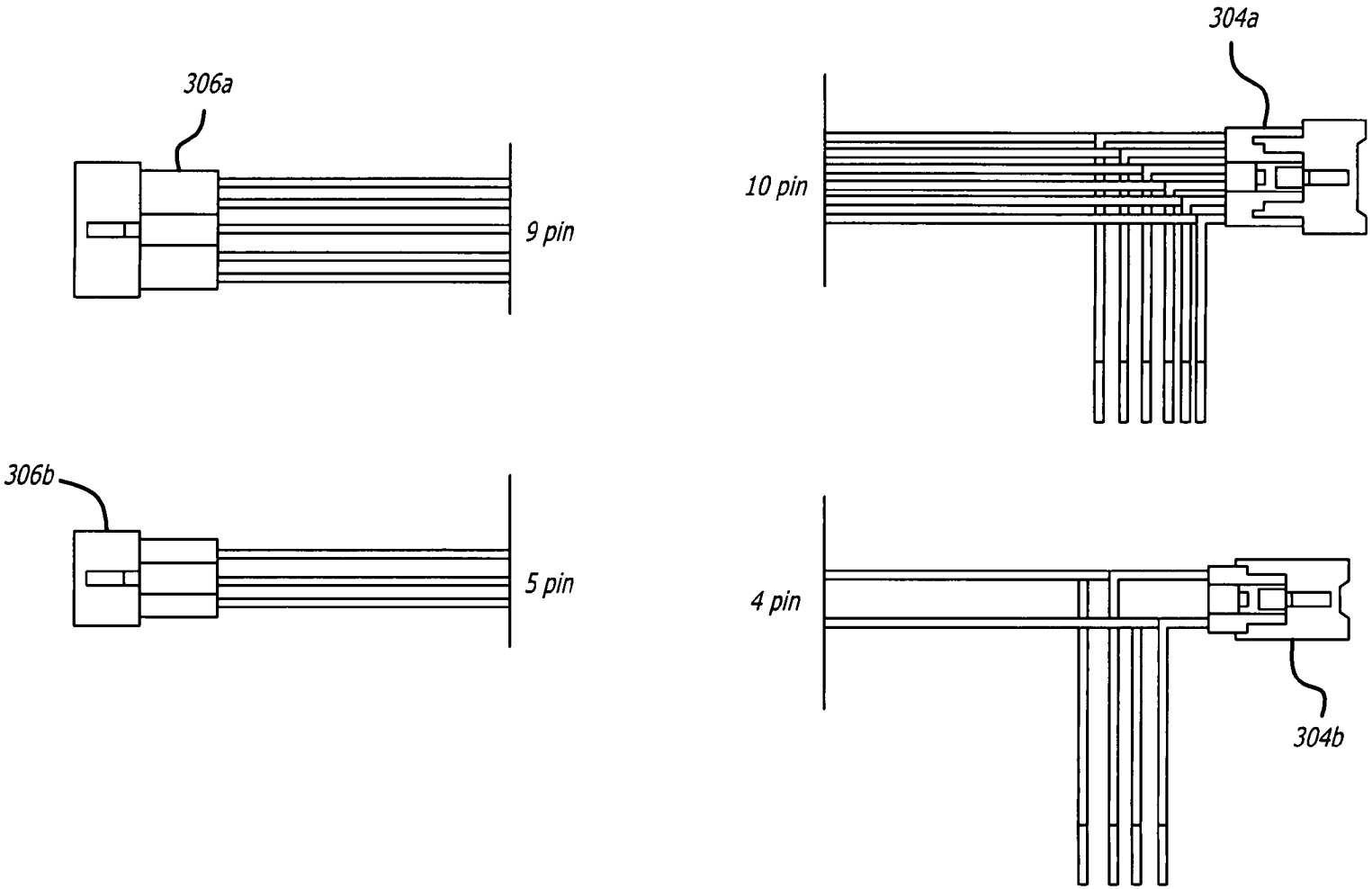
FIG. 3 is a wiring diagram for an embodiment of an adapter that can be used to install an aftermarket stereo into a Toyota.

FIG. 3 is a wiring diagram for an adapter that can be used to install an aftermarket stereo into a Toyota. The existing wiring harness in a Toyota has a pair of connectors, and therefore, the adapter 302 shown in FIG. 3 has two different pairs of connectors to interface an aftermarket stereo with Toyota automobiles from 1982 to present. The adapter is also suitable for connecting other model vehicles manufactured by Geo, Scion, and Lexus.

A first pair of connectors 304*a* and 304*b* on the adapter is used to connect an aftermarket stereo to a wiring harness in certain models and years of a Toyota, and a pair of connectors 306*a* and 306*b* is used to connect an aftermarket stereo to a wiring harness in other models and years of a Toyota. Extending from the rear of the first pair of connectors 304*a* and 304*b* is a bundle of wires for connection to the aftermarket stereo. Short jumper wires are used to connect the first pair of connectors 304*a* and 304*b* to the second pair of connectors 306*a* and 306*b*, resulting in a daisy-chain connection. The connector pins may be constructed of metal or other conductive material. The connectors 304*a*, 304*b*, 306*a*, and 306*b* may be made of plastic or other material. Structural details for these connectors are known in the art.

The wiring extends from the first pair of connectors 304*a* and 304*b* have stripped ends so that they may be readily connected to wires extending from the aftermarket stereo. The connections may be made by soldering or mechanical connection or other methods generally known in the art. The wires may be color-coded according to Electronics Industry Association (EIA) standards to ease installation of the adapter with the aftermarket stereo.

The first pair of connectors include a ten-pin connector 304*a* and a four-pin connector 304*b*. The ten-pin connector 304*a* is used to provide power from the battery to the aftermarket stereo. The same connector 304*a* is also used to provide audio signals from the aftermarket stereo to the front speakers and control signals to the antenna. The four-pin connector 304*b* is used to provide audio signals from the aftermarket stereo to the rear speakers.

The second pair of connectors include a nine-pin connector 306*a* and a five-pin connector 306*b*. Jumper wires are provided between the ten-pin connector 304*a* and the nine-pin connector 306*a* to provide power to aftermarket stereo, audio signals to the front speakers, and control signals to the antenna when the second pair of connectors are used. Similarly, jumper wires are provided between the four-pin connector 304*b* and the five-pin connector to provide audio signals to the rear speakers with the second pair of connectors. Power is also provided to the rear speakers in Toyota automobiles requiring the second pair of connectors by adding a jumper wire between the ten-pin connector 304*a* and the five-pin connector 306*b*.

The tables shown below provide for each connector pin the function and color-code.

First Pair of Connectors

| Pin | Connector 304a | Typical Toyota In Dash Wire Color |
|---|---|---|
| 1 | Illumination/Dimmer (12 V+) | Orange |
| 2 | Power Antenna | Blue |
| 3 | Power Antenna | Blue |
| 4 | Chassis Ground | Black |
| 5 | Left Front Speaker (−) | White/Black |
| 6 | Right Front Speaker (−) | Grey/Black |
| 7 | 12 Volt Battery | Yellow |
| 8 | 12 Volt Ignition | Red |
| 9 | Left Front Speaker (+) | White |
| 10 | Right Front Speaker (+) | Grey |

| Pin | Connector 304b | Typical Toyota In Dash Wire Color |
|---|---|---|
| 1 | Left Rear Speaker (−) | Green/Black |
| 2 | | |
| 3 | | |
| 4 | Right Rear Speaker (−) | Violet/Black |
| 5 | Left Rear Speaker (+) | Green |
| 6 | Right Rear Speaker (+) | Violet |

Second Pair of Connectors

| Pin | Connector 304a | Typical Toyota In Dash Wire Color |
|---|---|---|
| 1 | Illumination/Dimmer (12 V+) | Orange |
| 2 | Power Antenna | Blue |
| 3 | Chassis Ground | Black |
| 4 | Left Front Speaker (−) | White/Black |
| 5 | Right Front Speaker (−) | Grey/Black |
| 6 | Power Antenna | Blue |
| 7 | 12 Volt Ignition | Red |
| 8 | Left Front Speaker (+) | White |
| 9 | Right Front Speaker (+) | Grey |

| Pin | Connector 306b | Typical Toyota In Dash Wire Color |
|---|---|---|
| 1 | Left Rear Speaker (−) | Green/Black |
| 2 | +12 Volt Battery | Yellow |
| 3 | Right Rear Speaker (−) | Violet/Black |
| 4 | Left Rear Speaker (+) | Green |
| 5 | Right Rear Speaker (+) | Violet |

The adapter is described herein as connecting to an aftermarket stereo. However, it should be understood that the adapter may be configured to connect to other accessories such as digital audio players including iPod's and MP3 players, among others. Hence, the principles described herein may be used in products other than aftermarket stereos. The customer is provided with flexibility because they can use a single harness to connect aftermarket stereos and different types of cars.

The previous description is provided to enable any person skilled in the art to practice the various embodiments described herein. Various modifications to these embodiments will be readily apparent to those skilled in the art, and the generic principles defined herein may be applied to other embodiments. Thus, the claims are not intended to be limited to the embodiments shown herein, but is to be accorded the full scope consistent with the language claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for".

What is claimed is:

1. An adapter for installing an aftermarket audio device in a vehicle, comprising:

first and second connectors electrically connected together, the first connector being suitable for connecting to a wiring harness in the vehicle and the second connector being unsuitable for connection to the wiring harness in the vehicle; and a plurality of wires, each of the wires having one end electrically connected to the first and second connectors and an opposite stripped end for connecting to one of a plurality of wires extending from the aftermarket audio device.

2. The adapter of claim 1 wherein each of the wires are physically connected at one end to the same connector.

3. The adapter of claim 1 wherein the wires are color-coded according to EIA standards.

4. The adapter of claim 1 wherein the first and second connectors have a different number of pins.

5. The adapter of claim 1 wherein the first and second connectors have different physical dimensions.

6. The adapter of claim 1 wherein the first and second connectors are electrically connected together by jumper wires, and wherein at least one of the jumper wires extends from a pin in the first connector to a pin having a different location in the second connector.

7. An adapter for installing an aftermarket audio device in a vehicle, comprising:

first and second connectors electrically connected together, the second connector being adapted for a different wiring harness in a different vehicle; and a plurality of wires, each of the wires having one end electrically connected to the first and second connectors and an opposite stripped end for connecting to one of a plurality of wires extending from the aftermarket audio device.

8. The adapter of claim 7 wherein each of the wires are physically connected at one end to the same connector.

9. The adapter of claim 7 wherein the wires are color-coded according to EIA standards.

10. The adapter of claim 7 wherein the first and second connectors have a different number of pins.

11. The adapter of claim 7 wherein the first and second connectors have different physical dimensions.

12. The adapter of claim 7 wherein the first and second connectors are electrically connected together by jumper wires, and wherein at least one of the jumper wires extends from a pin in the first connector to a pin having a different location in the second connector.

* * * * *